United States Patent [19]

Matthews

[11] 4,156,119

[45] May 22, 1979

[54] CONTROLLED FEEDER BLOCK

[75] Inventor: Gary B. Matthews, Birchwood, Minn.

[73] Assignee: Minnesota Mining and Manufacturing Company, Saint Paul, Minn.

[21] Appl. No.: 904,514

[22] Filed: May 10, 1978

[51] Int. Cl.[2] ..... H01H 15/24

[52] U.S. Cl. ..... 200/51.03; 179/98; 200/16 F; 200/51.06; 200/51.07; 200/51.12

[58] Field of Search ..... 200/51.03, 51.04, 51.05, 200/51.06, 51.07, 51.09, 51.12, 16 B, 16 F, 254; 179/98; 339/198 R, 198 K, 198 S, 198 P

[56] References Cited

U.S. PATENT DOCUMENTS

| | | | |
|---|---|---|---|
| 3,202,953 | 8/1965 | Bosworth et al. | 200/51.09 |
| 3,627,942 | 12/1971 | Bobb | 200/51.12 |
| 3,663,780 | 5/1972 | Golbeck | 200/254 |
| 3,919,495 | 11/1975 | Berglund et al. | 179/98 |
| 4,053,719 | 10/1977 | Debortoi et al. | 179/98 |

*Primary Examiner*—Steven L. Stephan

*Attorney, Agent, or Firm*—Cruzan Alexander; Donald M. Sell; Robert C. Beck

[57] ABSTRACT

A controlled feeder block for use in a telecommunications interface provides a plurality of slidable switching assemblies, each of which is selectively used to connect an in-feeder wire to either an out-feeder wire or a wire receiving terminal.

6 Claims, 3 Drawing Figures

CONTROLLED FEEDER BLOCK

BACKGROUND OF THE INVENTION (1) Field of the Invention

This invention relates to a switching device, to connect an in-feeder wire to an out-feeder wire or to connect the in-feeder wire to a wire receiving terminal.

(2) Description of the Prior Art

In a prior art telecommunications network exemplified by U.S. Pat. No. 3,919,495 to Berglund et al, a cable containing a number of wire pairs is fed from a central office to a pair of cross connect cabinets, designated A and B, which are located within a distribution grid. Feeder pairs which appear at both the A and B interface are called common feeder pairs and patch plugs are used in the prior art to restrict the use of any given common feeder pair to either the A or the B interface unit, but not both simultaneously. When a cable pair is connected in series or patched through the A interface to the B interface by means of a patch plug, a distribution wire may only be attached at the B interface.

An advantage of this type of distribution system is that although common feeder pairs are available at either of the A or B interfaces, the central office identity of these pairs is maintained through the interface. This simplifies administrative procedures in assigning subscription service.

A commercially successful interface system must be reliable and compact so as to permit a large number of terminations to be made within the limited space available in a conventional cross connect cabinet. Also, the smallest number of components should be utilized to cross connect feeder pairs, and non-reuseable and loose parts should be eliminated to provide the most economical solution to the interface problem. It is also important to provide a connection procedure which is simple and unambiguous so as to prevent wiring errors when such a system is utilized in the field.

However, the Berglund et al system suffers from a number of defects. This prior art system requires a large number of non-reuseable patch plugs or jumpers which must be stored within the cross connect cabinet or carried to the cross connect cabinet site by the service personnel. The patch plug configuration of Berglund et al is inconvenient to use. This prior art solution requres complex components and specialized tools which must be skillfully used, to achieve a reliable connection. The complexity of these tasks increases the labor cost associated with making a reliable termination.

SUMMARY OF THE INVENTION

The applicant provides a controlled feeder block for electrically connecting a first wire which may be an in-feeder wire to either a second wire which may be an out-feeder wire or to a wire receiving terminal. The apparatus comprises an insulative feeder block which has first and second contact elements mounted therein. The first and second contact elements are constructed for electrical connection to the first and second wires, respectively. A terminal post is adapted to slide between a first and second position within said insulative block, said terminal post carrying both a terminal conductor which is electrically connected to the wire receiving terminal, and a bridging conductor in electrical isolation. This bridging conductor makes electrical contact with both the first and second contact elements when the terminal post is in the first position. When the terminal post is in the second position, the terminal conductor makes electrical contact with the first contact element.

DESCRIPTION OF THE PREFERRED EMBODIMENTS

Figure 1:
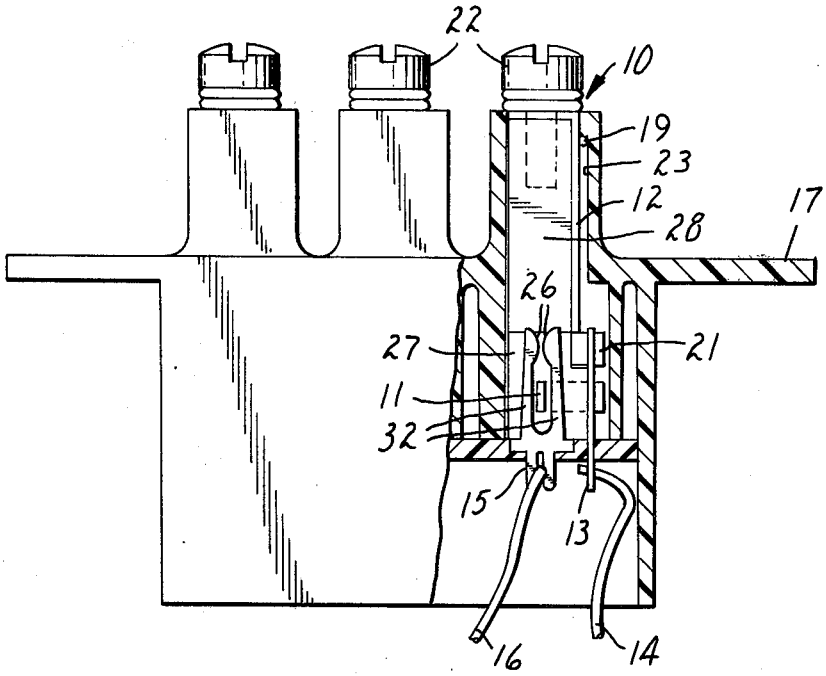
FIG. 1 is a cross sectional elevation of a completed controlled feeder block.

Referring to FIG. 1, an assembled terminal post assembly 10 is shown within the insulative controlled feeder block 17. The terminal post assembly carries in electrical isolation a bridging conductor 11 and a terminal conductor 12. Preferably, this result can be achieved by carrying bridging conductor 11 within an insulative terminal post base 27, which may be attached to a conductive terminal post 28. The completed terminal post switch assembly is shown in the second position in FIG. 1. In this position, the terminal conductor 12 is in contact with the first contact element 13 which is in turn connected to in-feeder wire 14. The terminal conductor has a portion formed as a flat blade 21 which makes resilient electrical contact with the contact element 13. This terminal conductor 12 extends the length of the terminal post assembly and is in electrical contact with a binding post screw 22 which forms a wire receiving terminal. A small raised dimple 19 cooperates with slot 23 in the insulative carrier block 17 to form a detent means which prevents the translation of the terminal post assembly between its first and second positions unless a force of a predetermined magnitude is applied to the terminal post. In this second position, the bridging conductor is located in a wide mouth portion of the contact elements and, therefore, does not make electrical contact with the contact elements.

Figure 2:
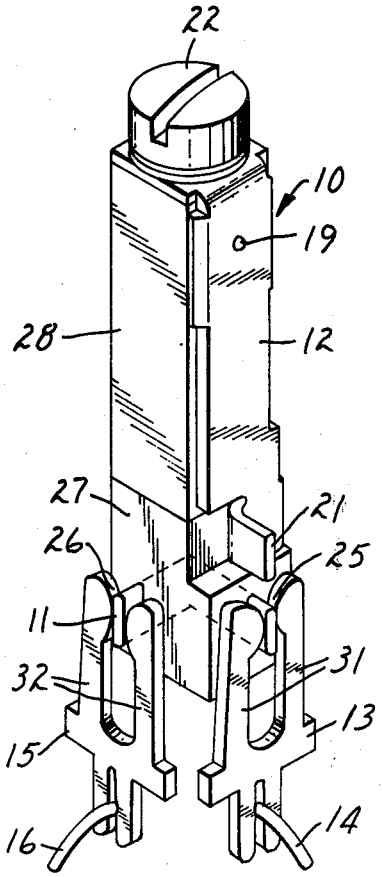
FIG. 2 is a perspective view of the terminal post switch assembly in the first position.

FIG. 2 depicts the terminal post assembly in its first position. In this position, the blade-like portions of the bridging conductor 11 are in electrical contact with the contact areas 25 and 26 of contact elements 13 and 15. Consequently, electrical continuity is established between in-feeder wire 14 and out-feeder wire 16. These contact areas 25 and 26 are defined by a narrow entry portion of the blade receiving slot formed by the bifurcated arm portions 31 and 32. The bridging conductor 11 is carried within the insulative terminal post base 27 which is mechanically attached to the terminal post 28. The terminal post 28 is preferably made from metal when a binding post screw 22 is used as the wire receiving terminal; however, the terminal post 28 and the terminal post base 27 may be combined as a single non-conductive member.

Figure 3:
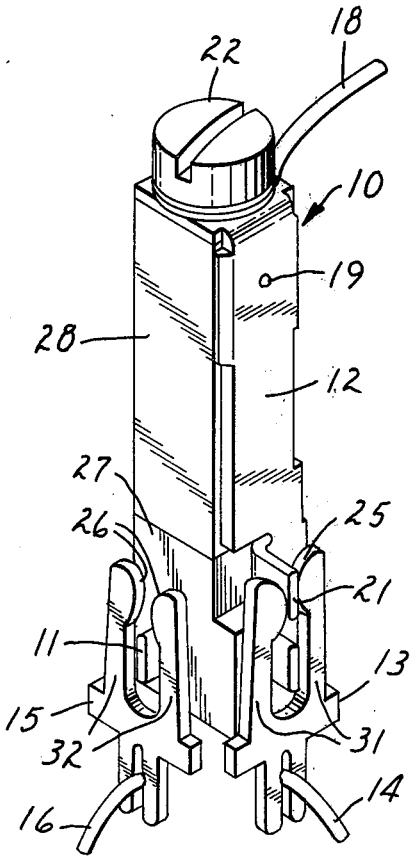
FIG. 3 is a perspective view of the terminal post switch assembly in the second position.

FIG. 3 shows the terminal post assembly in the second position. In this position, the terminal post assembly 10 is translated within the insulative carrier block and the blade-like portions of the bridging conductor 11 are moved out of contact with the narrow entry portions of contact elements 13 and 15 and are moved into the wider mouth portions of the blade receiving slots where they are electrically isolated. In this second position, the blade-like portion 21 of the terminal conductor 12 is in contact with the contact areas 25 of the first contact element 13. In this position, electrical continuity is established between the in-feeder wire 14 and the wire receiving terminal. Distribution wire 18 may be connected to the wire receiving terminal shown as binding screw 22.

Having thus described the present invention, what is claimed is:

1. A controlled feeder block for electrically connecting a first wire to either a second wire or a wire receiving terminal comprising:

an insulative block, first and second contact elements mounted in said insulative block, said first and second contact elements being constructed for electrical connection to first and second wires, respectively, a terminal post adapted to slide between a first position and a second position within said insulative block said terminal post carrying in electrical isolation, a terminal conductor electrically connected to a said wire receiving terminal and a bridging conductor, said bridging conductor making electrical contact with both said first and second contact elements when said terminal post is in said first position, and said terminal conductor making electrical contact with said first contact element when said terminal post is in said second position.

2. The controlled feeder block of claim 1, wherein each of said contact elements has a bifurcated portion forming a pair of arms, said arms having opposed edges defining a slot, said slot having a narrow entry portion for resiliently receiving a conductor into electrical contact, and a wide throat portion adapted to receive a conductor without establishing electrical contact between said conductor and said contact element, and wherein said bridging conductor makes electrical contact in the entry portion of each contact element when said terminal post is in said first position and slides into the throat of the contact element upon movement of said terminal post to said second position.

3. The controlled feeder block of claim 1, wherein said insulative block has a plurality of said terminal posts arranged in rows and columns.

4. The controlled feeder block of claim 1, wherein said wire receiving terminal is formed by a binding post screw onto said terminal post.

5. The controlled feeder block of claim 1, wherein said terminal post assembly is formed as an insulative terminal post base attached to a conductive terminal post which is threaded to receive a binding post screw.

6. The controlled feeder block of claim 1, further including detent means to prevent the sliding of said terminal post between its first and second positions unless a force of a predetermined magnitude is applied to said terminal post.

* * * * *